US007018211B1

(12) United States Patent
Birkhölzer et al.

(10) Patent No.: US 7,018,211 B1
(45) Date of Patent: Mar. 28, 2006

(54) SYSTEM FOR ENABLING A MOVING PERSON TO CONTROL BODY MOVEMENTS TO BE PERFORMED BY SAID PERSON

(75) Inventors: Thomas Birkhölzer, Weisendorf (DE); Kai-Uwe Schmidt, Erlangen (DE); Patrick Winter, Toronto (CA)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 09/762,837

(22) PCT Filed: Aug. 16, 1999

(86) PCT No.: PCT/DE99/02567

§ 371 (c)(1),
(2), (4) Date: Feb. 13, 2001

(87) PCT Pub. No.: WO00/12183

PCT Pub. Date: Mar. 9, 2000

(30) Foreign Application Priority Data

Aug. 31, 1998 (DE) ..... 198 39 638

(51) Int. Cl.
*G09B 19/00* (2006.01)

(52) U.S. Cl. ..... 434/257; 434/247; 434/250; 434/252; 434/256; 434/257

(58) Field of Classification Search ..... 434/247–258; 348/77, 589, 601; 345/112, 113, 121; 473/266
See application file for complete search history.

(56) References Cited

U.S. PATENT DOCUMENTS

| | | | | |
|---|---|---|---|---|
| 3,408,750 | A | 11/1968 | McCollough et al. | |
| 4,891,748 | A * | 1/1990 | Mann | 364/410 |
| 4,936,299 | A | 6/1990 | Erlandson | |
| 5,249,967 | A * | 10/1993 | O'Leary et al. | 434/247 |
| 5,486,001 | A * | 1/1996 | Baker | 473/266 |
| 5,559,554 | A * | 9/1996 | Uekane et al. | 348/333.02 |
| 5,586,557 | A | 12/1996 | Nelson et al. | |
| 5,826,578 | A * | 10/1998 | Curchod | 600/595 |
| 5,904,484 | A | 5/1999 | Burns | |
| 5,984,684 | A * | 11/1999 | Brostedt et al. | 434/252 |
| 6,244,987 | B1 * | 6/2001 | Ohsuga et al. | 482/4 |
| 6,293,802 | B1 * | 9/2001 | Ahlgren | 434/252 |

FOREIGN PATENT DOCUMENTS

EP 0 700 694 A1 3/1996

OTHER PUBLICATIONS

WPI Acc. No. 1996-140827 with English-language abstract for EP 0 700 694 A1.

* cited by examiner

*Primary Examiner*—Monica S. Carter
*Assistant Examiner*—Cameron Saadat
(74) *Attorney, Agent, or Firm*—Siemens AG; Jacob Eisenberg

(57) ABSTRACT

The present invention relates to a system for enabling a moving person to control body movements to be performed by the person. The system comprises a video camera and a monitor for the output of the recorded video image as well as a means for inserting at least a mark indicating the position to reach during execution of a movement of a predetermined body position in the video image.

20 Claims, 3 Drawing Sheets

SYSTEM FOR ENABLING A MOVING PERSON TO CONTROL BODY MOVEMENTS TO BE PERFORMED BY SAID PERSON

BACKGROUND OF THE INVENTION

The invention relates to a system for enabling self-monitoring, with regard to body movement sequences to be carried out, by the moving person.

Practicing specific movements or movement sequences plays an important part for example in the context of rehabilitation. In this case, the subject or patient practises specific movement sequences in order to train his/her overall body mobility or, alternatively, in order, for example, to influence specific body parts or muscle groups in a targeted manner. However, the targeted practicing of specific movement sequences is also an important therapeutic element for physically disabled persons. When practicing these movement sequences or when carrying out the training exercises, it is often crucial that the movements be performed "correctly", that is to say that a predetermined movement sequence be adhered to in the best possible manner. It would be desirable here to identify deviations, to the extent possible, in the course of the movement, in order to be able to immediately correct them and thereby avoiding the situation where an exercise is repeatedly carried out "incorrectly" which cannot lead to the therapeutic success sought. On the contrary, in this case there is even the risk that, on account of the "incorrect" movement sequence, there will be no improvement at all, or even a deterioration.

Self-perception of a subject's own movements is often insufficient for adequate monitoring. One reason for this is that self-perception can be disturbed, for example on account of specific disturbances to the subject's health. It is, furthermore, often not possible for one to visually observe his or her movements which may require a rear view or side view. Finally, when carrying out a complex, dynamic procedure, self-perception may be overtaxed. In other words, the patient cannot simultaneously concentrate both on correctly carrying out the complex movement sequence and on detecting any movement errors. In order to remedy this, it would be possible to enlist an external observer, such as a trainer or therapist. However, this involves effort and is very expensive. Furthermore, it is possible to utilize mirrors and the like for continuous self-observation. The disadvantage in this case is that, in spite of everything, the actual ideal body position or the ideal movement sequence cannot be identified. In other words, adequate monitoring cannot be achieved by this means either. Finally, there also remains the possibility of capturing the movement sequence by means of a video recording and subsequent observation and analysis. However, real time self-monitoring during movement is not possible in this case either.

EP 0 700 694 A1 discloses a training and diagnosis method in which the person who is training has to carry out a movement using a training device. A measurement recording is made and used to detect movement. The recording is displayed in the form of a curve representing the movement course. The recording is displayed on a monitor. With respect to the curve, it is possible to insert a predetermined curve to be reconstructed by the person who is training.

WO 98/28053 describes a device for carrying out interactive movement training in which optimum movement sequences are stored in a memory. While the exercises are being carried out, a video camera captures an image of the person who is training. The image is superposed on the stored video sequences. The person who is exercising simultaneously sees himself and the optimum movement sequence on a monitor and can compensate for any deviations. What is disadvantageous here, however, is that the person who is training has to adapt the speed at which he performs an exercise to the speed at which the video sequence is reproduced. The reproduction speed is, however, adjustable.

U.S. Pat. No. 3,408,750 describes an apparatus in which the position of a golf player is recorded by a video camera. A video recording of an optimum movement sequence is simultaneously displayed on a monitor. There is, however, no interactivity between the recorded movement and the real movement.

A system for the insertion of an optimum trajectory, in a game of basketball, by a laser beam, is disclosed in U.S. Pat. No. 5,365,427. However, the targeted training and monitoring of individual movement sequences is not possible in this way.

SUMMARY OF THE INVENTION

The present invention is thus based on the problem of specifying a system of the type mentioned in the introduction which avoids the disadvantages mentioned.

In order to solve this problem, a system of the type mentioned in the introduction is provided, according to the invention, comprising: a video camera and a monitor for outputting the recorded video image; and means for inserting at least one moving marker indicating a predetermined movement or body position, the marker being inserted into the video image, the insertion means being designed for detecting characteristic points, lines, contours or the like of the person who is performing a movement sequence and is shown in a recorded video image sequence, or of the person's area shown, and for automatically adapting the movement speed of the moving marker to the movement speed of the moving person, or of the person's area.

On the one hand, the system according to the present invention utilizes the possibility whereby images that have been captured by means of the video camera can be reproduced "live" on the monitor, so that the person can follow the movement sequence directly on the screen. The insertion means that is furthermore provided now makes it possible, in a particularly advantageous manner, to insert into the live image supplied by the video camera one or more markers indicating the ideal body position with regard to the movement sequence predetermined by, for example, a therapist. The patient is thus continuously shown the desired position with regard to the previously known movement sequence, which he can immediately compare with the current actual position in which he is in and which he can see from the live video image. The subject can thus identify deviations from the desired position indicated by means of the markers, and can immediately correct them. This enables the subject to identify and perform the "correct" movement, so that the therapeutic success to be attained by the movement training can actually be achieved. As for the marker, it is possible to insert, by way of example, one or more points assigned, for example, to different body extremities, and also one or a plurality of lines, in particular in the form of a stylized person ("matchstick man") or, alternatively, in the form of contour lines and the like. The user can also choose between these as desired, depending on which display form he personally prefers for self-monitoring. The movements to be carried out and the position of the markers are stipulated by the trainer or therapist according to e.g. medical standpoints.

The insertion means is designed for inserting a moving marker indicating a predetermined, ideal body movement. The marker moves in parallel with and at the same time as the body. In other words, the subject is shown the ideal desired position at every instant, which he can compare with the actual position in accordance with his own video image. This is expedient when it is important not only to attain a specific body position, as in the case described above, but also for the body movement to follow an ideal movement line or direction.

If the speed of the movement is not important, in specific movement sequences, for example in the case of power training, according to the invention the insertion means designed for detecting characteristic points, lines, contours or the like of the person who is performing a movement sequence and is shown in a recorded video image sequence, or of the person's area shown, can be designed for automatically adapting the movement speed of a moving marker to the movement speed of the moving person or of the person's area.

The means for inserting the marker can, according to the invention, be directly integrated in the video camera. In video cameras, the insertion of graphic elements, e.g. in the form of an overlay, into the video image, is a known standard function with which e.g. the time or date can be inserted as text into the video film. The means, a graphics processor, which is integrated, according to the invention, in the video camera, merely has to be configured or programmed in accordance with the marker to be inserted in the case of the system according to the invention. As an alternative to this, it is also possible, to integrate the means, that is to say the graphics processor, directly in the monitor or to use an interposed insertion means, for example in the form of a personal computer, which is arranged in the communications connection between the video camera and the monitor (e.g. a communications line).

According to the invention, the insertion means can also be designed for inserting a marker which is stationary during the body movement. In other words, in the case of this invention alternative, during the body movement in which, by way of example, the right arm and the right leg are to be simultaneously swung into a specific position, the ideal end positions to be taken up respectively by the arm and leg are indicated. In this case, the subject recognizes whether he is now actually swinging his arm or his leg to an extent such that he is attaining the therapeutically ideal desired position, or whether his swing is too short or far, for example.

As described, the marker or markers serves or serve for indicating an ideal desired body position. In other words, the position or size and the like of the marker must be adapted and related to the position and the size, etc. of the person shown in the video image.

The "position and size" of the person shown in the image depends, on the one hand, on the size of the person himself/herself and, on the other hand, on the setting of the video camera or the distance thereof from the person. Moreover on whether, by way of example, only a specific body area is to be displayed, for example only a leg which is to be moved in a targeted manner, and which is then moved into the video image using a zoom device of the video camera.

To provide a simple possibility ensuring that the person is correctly positioned with respect to the video camera, in order that, with respect to the person shown in the video image, the markers are inserted at the correct location based on the size of the person shown in the image, according to the invention it is possible to insert one or more markers which serve as adjustment markers and, by way of example, specify where the top of the head and where the feet and the like must be positioned in the video image. The person who is training then merely has to choose his position with respect to the video cameras such that his head and feet and the like are congruent with the adjustment markers inserted into the video image. In addition to these markers serving for adjustment, the further markers indicating the movement or body position to be attained are then inserted. In this case, the person who is training must maintain a fixed position with respect to the video camera.

In order to enable simple adaptation and correlation, according to the invention, the insertion means can be designed for detecting characteristic points, lines, contours or the like of the non-moving person shown in the recorded video image, or of the person's area shown, and for automatically adapting the marker, in particular the latter's size and/or insertion position, in a manner dependent on the detection result. The insertion means is thus able to use the video image to detect the relevant information with regard to the person shown or the person's area, so that, using appropriate processing technology, the marker, that is to say, for example, the size of the "matchstick man", can then be related to the size of the detected person. This is expediently done when the person is not moving, since it is then a simple matter to detect said person's characteristic points.

As an alternative, it is possible for the insertion means to be designed for detecting characteristic points, lines, contours or the like of the person who is performing a movement sequence and is shown in a recorded video image sequence, or of the person's area shown, and for automatically adapting the marker, in particular the latter's size and/or insertion position, in a manner dependent on the detection result. In this configuration of the invention, therefore, firstly a complete movement sequence is recorded by means of the video camera. This can be done under supervision, for example, so that the subject performs the movement in the best possible way. In this case, it is then possible at the same time to recognize what the subject is currently able to do, so that, if appropriate in addition to the automatic adaptation, manual intervention may also be made in the representation sequence of the marker, which may likewise be provided according to the invention. In this way, in the manner of a "teach-in", the ideal movement specification, that is to say the insertion data of the marker, can thus be generated in accordance with the actual ability of the subject to move, and be specifically geared to said subject. The trainer or therapist can thus generate the specific desired movement sequence for the respective subject, defined by the marker(s).

If the speed of the movement is not important in specific movement sequences, for example in the case of power training, according to the invention the insertion means designed for detecting characteristic points, lines, contours or the like of the person who is performing a movement sequence and is shown in a recorded video image sequence, or of the person's area shown, can be designed for automatically adapting the movement speed of a moving marker to the movement speed of the moving person or of the person's area. As described, in addition to automatic adaptation/variation, manual variability of the size and/or of the insertion position and/or of the movement speed of the marker may also be provided.

In a further configuration of the invention, the insertion means may be assigned a storage means in which, for a plurality of different predetermined body movement sequences, the respective insertion data of at least one marker is stored and can be selected by the user as desired.

This enables a subject who, in the context of his rehabilitation or training, has to carry out a plurality of different movement sequences to select the marker sequence intended for the respective movement sequence, so that that marker sequence is displayed.

BRIEF DESCRIPTION OF THE SEVERAL VIEWS OF THE DRAWINGS

Further advantages, features and details of the invention emerge from the exemplary embodiment described below and from the drawings, in which.

DETAILED DESCRIPTION OF THE INVENTION

Figure 1:
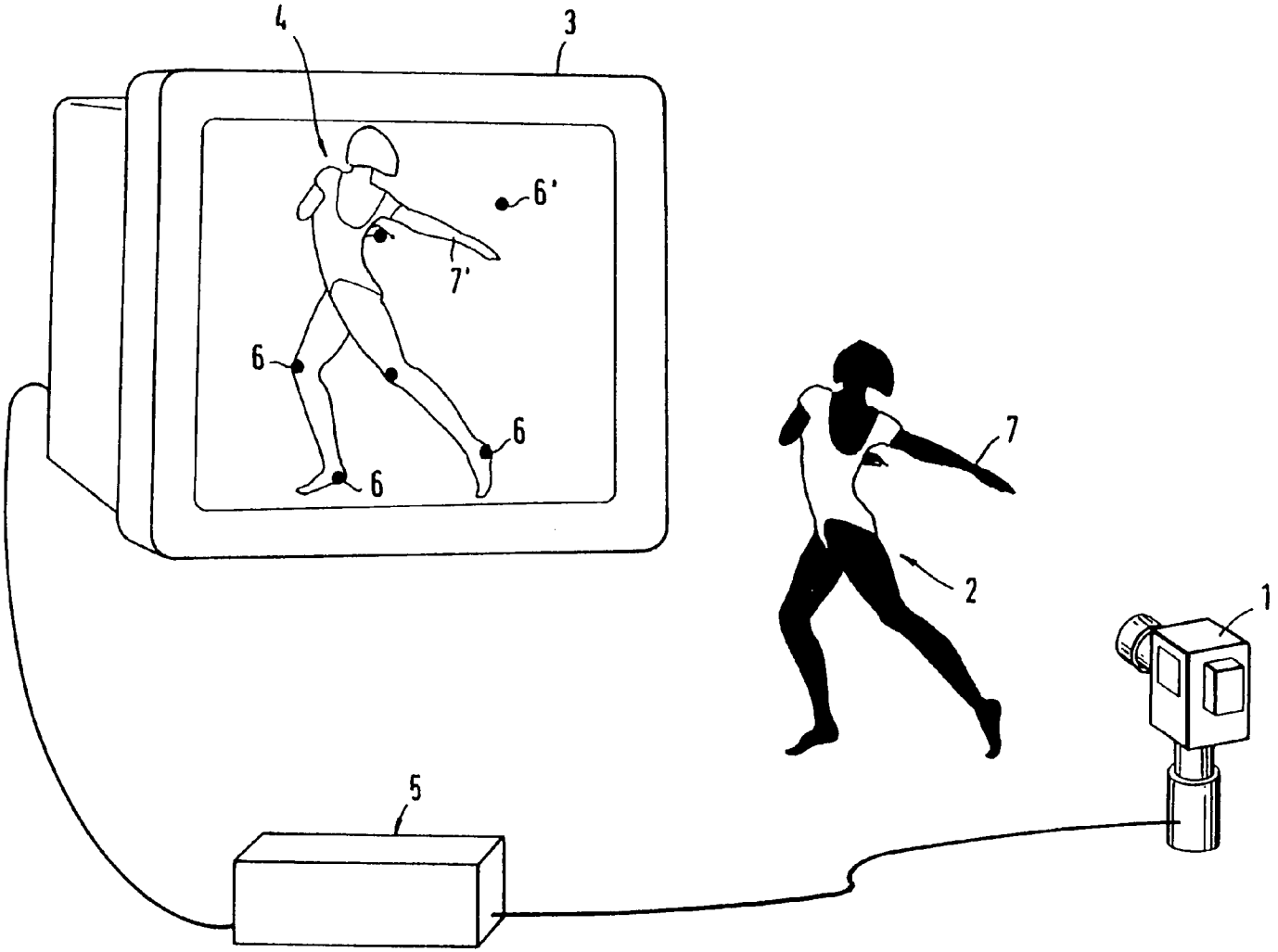
FIG. 1 shows a system of a first embodiment.

The system according to the invention comprises a video camera 1, which is used to record the movements of a person 2. The video camera 1 is connected via a corresponding data line to a monitor 3, on which the recorded video image 4 can be output live or in real time. As an alternative to the data line, line-free communication is also conceivable. An insertion means 5 is connected between video camera 1 and monitor 3. The insertion means 5 serves for inserting into the shown video image 4 at least one marker indicating an ideal desired body position which should ideally be taken up by the person 2 who is carrying out a specific movement sequence. In the example shown, a plurality of markers 6 in the form of points are inserted into the video image 4. These points 6 can be perceived visually by the person 2. In the example shown, the markers 6 are assigned to the various body extremities. Two markers 6 are assigned to the feet, two additional markers are assigned to the knees, and the last two depicted markers are assigned to the hands. From the coincidence or non-coincidence of the markers 6 with the respective body parts of the person 2 in the video image 4, the person 2 can recognize whether or not his/her body position corresponds to the desired position predetermined by the markers 6. In the exemplary embodiment shown, the movement is performed correctly insofar as the position and the posture of the left arm correspond to the movement specifications. However, the posture of the right arm 7 deviates from the desired position since the arm 7' shown in the video image 4 is not congruent with the assigned marker 6'. The person 2 can immediately recognize this deviation from the desired position, during the movement, and then correct it accordingly, so that the subsequent movement sequence can be carried out in a manner approximated even further to the desired position.

Figure 2:
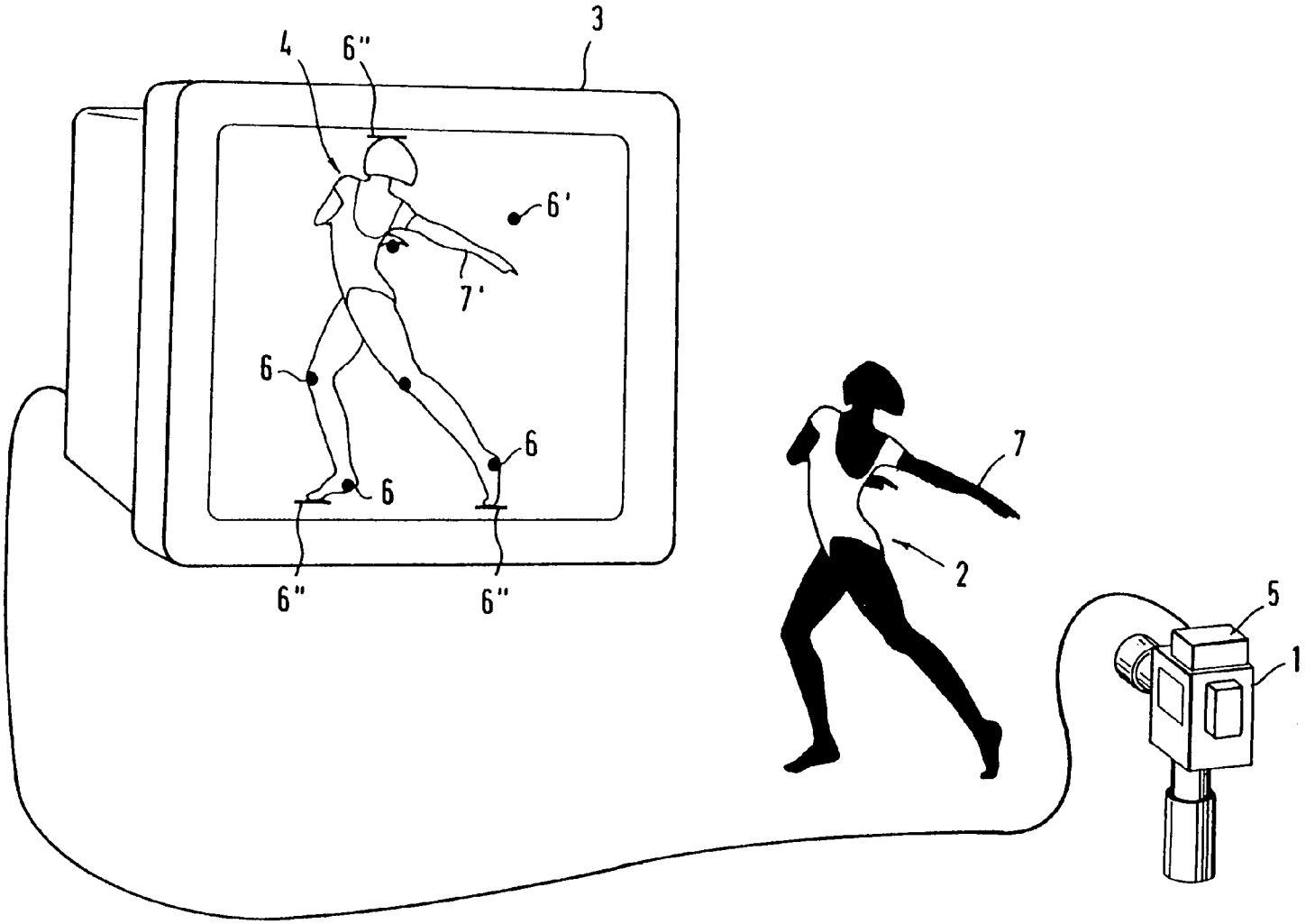
FIG. 2 shows a system of a second embodiment.
Figure 3:
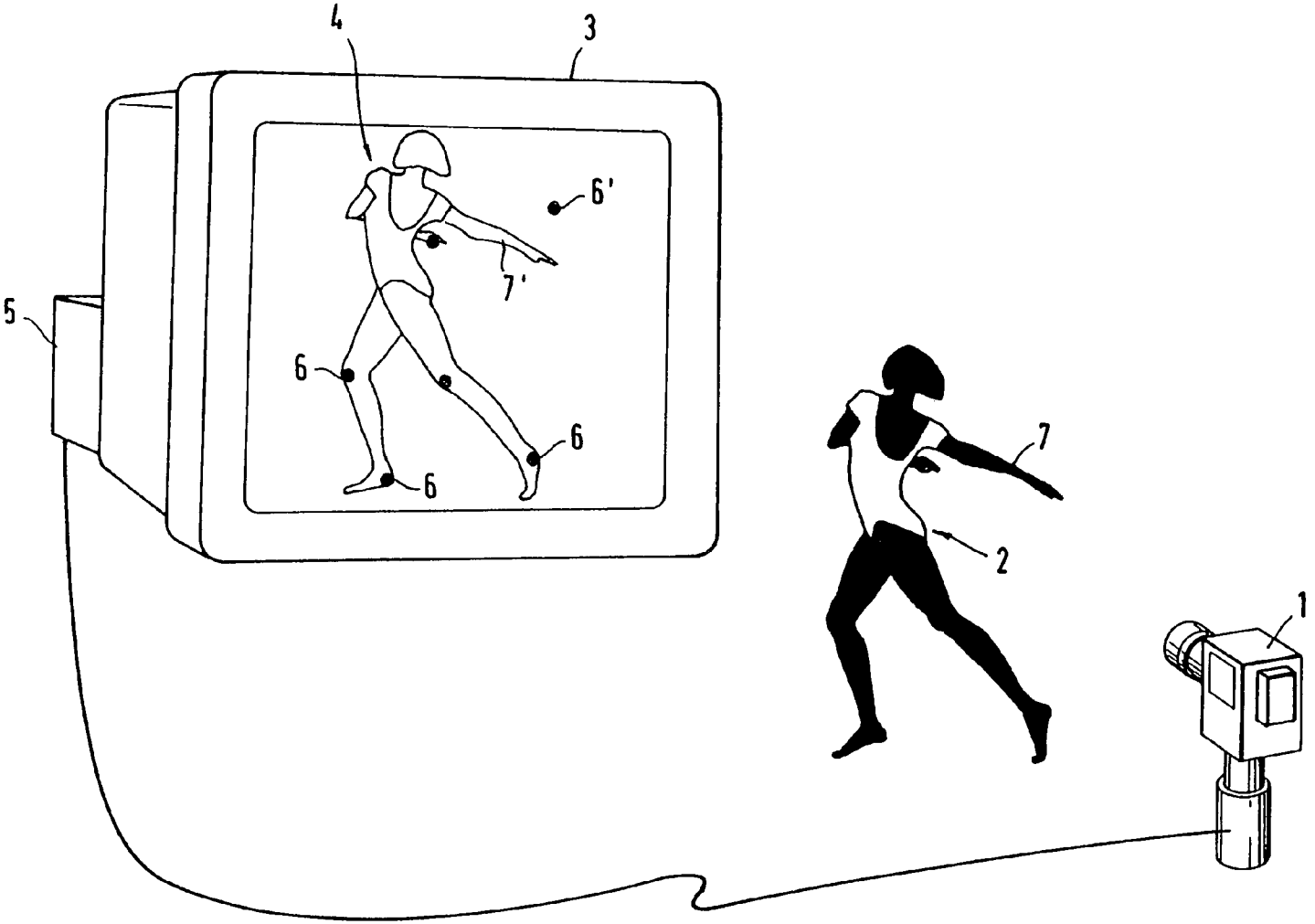
FIG. 3 shows a system of a third embodiment.

FIGS. 2 and 3 show two system variants in which the insertion means 5 is integrated in the video camera (FIG. 2), or alternatively in the monitor (FIG. 3). In each case the means comprises an appropriately designed graphics processor which can be appropriately programmed for insertion of the markers. Furthermore, FIG. 2 shows stationary markers 6" which are inserted into the video image and serve for adjustment or positioning of the person with respect to the video camera 1. The person changes his/her position with respect to the video camera 1 until e.g. the head and feet of the person in the video image are congruent with the respective markers 6".

The insertion means 5, as is provided e.g. in the systems according to FIGS. 1 and 3, may furthermore be able to detect, within the video image 4, characteristic points, lines or contours of the person shown. From this it is possible to identify the size, position, etc. of the person shown in the video image 4, and to correspondingly adapt the insertion of the markers 6, since the latter have to be related to the size of the person shown. If the person shown in the video image were, for example, represented only half as large, for example if the video camera 1 were arranged at a corresponding distance from the person, then if there were no change to the insertion positions of the markers 6 shown in the example, said markers would be inserted completely incorrectly. In other words an actual/desired position comparison would not be possible in this case. This adaptation can be effected automatically, expediently being done when the person is not moving.

In addition, instead of (or, if appropriate, in addition to) the automatic adaptation of the marker position and/or size, it is possible (as described with respect to FIG. 2) that the insertion means 5 can insert in the video image stationary markers serving for positioning e.g. the head and feet of the person, and for adjustment. In this case, the person only has to position himself/herself relative to the video camera in such a way that the head shown in the video image and the feet are congruent with the respective markers. In this case, the person must maintain this taken-up position during the exercise.

Furthermore, the insertion means is designed for inserting stationary markers, which only define ideal end positions of the body, and for inserting markers which move with the person. If it is not important to adhere to a specific movement speed during the movement sequence that is carried out, the insertion means 5 is furthermore able to adapt the movement speed of the markers 6 in accordance with the movement speed of the person. In the case of automatic adaptation this adaptation is effected when the person is moving. In addition, the respective parameters of the marker can also be varied manually in order to be able, as desired, to effect manual correction or adaptation. In addition to the embodiment of the markers 6 in the form of points which is shown in the example, they can, for example, also be inserted in the form of lines, e.g. in the form of a stylized person ("matchstick man") or the like. Finally, the insertion means 5 may also be assigned an expediently integrated storage means in which the insertion data of the markers for different movement sequences to be carried out by the subject are stored, and which can be selected as desired by the subject.

The invention claimed is:

1. A system for self-monitoring by a moving person of body movements, comprising:

a) a video camera configured to generate a recorded video image or image sequence representing body movements of moving person;

b) a monitor operatively coupled to the video camera for outputting the recorded video image or image sequence representing the body movements of the moving person; and c) an insertion component configured to insert at least one moving marker dependent upon at least one position of the moving person's various body extremities, indicating an ideal movement or body position, into the video image or image sequence representing the body movements of the moving person; to detect at least one of characteristic points, lines, contours, and various body extremities of at least one of the person shown in the recorded video image and of the displayed area of the person, while the person is not moving; to automatically adapt the marker in a manner dependent on a detection result; and to automatically adapt a size or insertion position of the marker in a manner dependent on the detection results;

wherein the insertion component is configured to detect characteristic points, lines, contours, or equivalent characteristics of the moving person or of a displayed area of the moving person, wherein the moving person is performing a body movement sequence and is shown in the recorded video image sequence, and wherein the insertion component is configured to automatically adapt the movement speed of the moving marker to the movement speed of the moving person or of a displayed area of the moving person; wherein the movement and position of the moving marker is specified by a trainer, and wherein one or more moving markers are assignable to one or more of the various body extremities.

2. A system as claimed is claim 1, wherein the insertion component is configured for inserting at least one stationary marker that is stationary during the body movement and indicates a predetermined, ideal body movement.

3. A system as claimed in claim 2, wherein the insertion component is configured for inserting at least one stationary marker suitable for adjustment of the person with respect to the video camera.

4. A system as claimed in claim 1, wherein the insertion component is configured to automatically adapt a size and insertion position of the marker in a manner dependent on the detection result.

5. A system as claimed is claim 1, wherein the system is configured for manually varying size or insertion position or movement speed of the marker.

6. A system as claimed is claim 1, further comprising a storage component operatively coupled to the insertion component, wherein for a plurality of different predetermined body movement sequences, insertion data is stored for at least one marker, and the person may select from among the stored insertion data.

7. A system as claimed is claim 1, wherein the moving marker comprises one or more point(s) or line(s).

8. A system as claimed in claim 7, wherein the one or more points(s) or line(s) form a stylized person.

9. A system as claimed in claim 1, wherein the insertion component is configured to automatically adapt a size and insertion position of the marker in a manner dependent on the detection result.

10. A system as claimed in claim 1, wherein the system is configured for manually varying size and insertion position or movement speed of the marker.

11. A system as claimed in claim 9, wherein the one or more point(s) or line(s) form an equivalent to a stylized person.

12. A system as claimed in claim 1, wherein the system is configured for manually varying size or insertion position and movement speed of the marker.

13. A system as claimed is claim 1, wherein the system is configured for manually varying size and insertion position and movement speed of the marker.

14. A system as claimed in claim 1, wherein the moving marker comprises one or more point(s) and line(s).

15. A system as claimed in claim 14, wherein the one or more point(s) and line(s) form a stylized person.

16. A system as claimed in claim 15, wherein the one or more point(s) and line(s) form an equivalent to a stylized person.

17. A system as claimed in claim 1, wherein the system is configured for manually varying size and insertion position and movement speed of the marker.

18. A system as claimed in claim 1, wherein the moving marker comprises one or more point(s) and line(s).

19. A system as claimed in claim 18, wherein the one or more point(s) and line(s) form a stylized person.

20. A system as claimed in claim 19, wherein the one or more point(s) and line(s) form an equivalent to a stylized person.

* * * * *